US006653923B2

(12) United States Patent
Li et al.

(10) Patent No.: US 6,653,923 B2
(45) Date of Patent: Nov. 25, 2003

(54) INDUCTOR MANUFACTURE AND METHOD

(75) Inventors: Yanjing Li, Coconut Creek, FL (US); Mathew Paul Sespaniak, Wellington, FL (US)

(73) Assignee: Cooper Technologies Company, Houston, TX (US)

( * ) Notice: Subject to any disclaimer, the term of this patent is extended or adjusted under 35 U.S.C. 154(b) by 121 days.

(21) Appl. No.: 09/884,550

(22) Filed: Jun. 19, 2001

(65) Prior Publication Data

US 2002/0190834 A1 Dec. 19, 2002

(51) Int. Cl.[7] ..... H01F 27/30
(52) U.S. Cl. ..... 336/206; 336/65; 336/90; 29/602.1
(58) Field of Search ..... 336/206, 65, 90; 29/602.1

(56) References Cited

U.S. PATENT DOCUMENTS 3,617,965 A * 11/1971 Trench et al. ..... 336/61
3,662,461 A * 5/1972 Lake et al. ..... 29/605

FOREIGN PATENT DOCUMENTS

JP 58128711 A * 8/1983 ..... 336/65

* cited by examiner

*Primary Examiner*—Elvin Enad
*Assistant Examiner*—Jennifer A. Poker
(74) *Attorney, Agent, or Firm*—Armstrong Teasdale LLP

(57) ABSTRACT

A method for fabricating an inductor which includes a core, a shield and a length of epoxy tape is provided which includes the steps of winding the wire into a coil onto the core, wrapping the epoxy tape around a perimeter of the core, installing the core including the coil and epoxy tape into the shield, and heating the inductor causing the epoxy tape to bond to the shield. An inductor incorporating the method is also described.

15 Claims, 3 Drawing Sheets

INDUCTOR MANUFACTURE AND METHOD

BACKGROUND OF THE INVENTION

This invention relates generally to manufacture of electronic components, and more specifically to manufacturing of inductors.

At least one type of Inductor includes a conductive wire wrapped around a core, sometimes referred to as a drum. The wrapped wire is commonly referred to as a coil, with each end of the coil being referred to as a lead for coupling the inductor to an electronic circuit. A shield is disposed around the coil, and consequently around the core, for isolation of the coil from electromagnetic fields which could induce undesirable voltages in the coil, as well as to mechanically protect the coil from unintentional contact and environmental conditions during manufacture, assembly, and installation of inductors to printed circuit boards and circuitry. As spacing between the coil and the shield can affect open circuit inductance and bias (an open circuit inductance with DC current) of an inductor, centering of the coil to maintain a consistent spacing between the coil, wound on the core, and the shield is important to the consistent manufacture of reliable, high quality inductors. Use of mechanical tooling to center the coil, and subsequently the core, within the shield is difficult and expensive to implement.

Manufacturing processes for inductors, like other components, have been scrutinized as a way to reduce costs in the highly competitive electronics manufacturing business. Reduction of manufacturing costs are particularly desirable when the components being manufactured are low cost, high volume components. In a high volume component, any reduction in manufacturing costs is, of course, significant. Manufacturing costs as used herein, refers to material cost and labor costs. It is possible that one material used in manufacturing a component, may have a higher cost than another material, but the labor savings more than makes up for the increase in material costs. It is also possible that the opposite is true in other component manufacturing circumstances.

Conventionally, to avoid mechanical tooling costs in inductor fabrication, an adhesive tape has been used as a spacer between the core and the shield. A liquid epoxy adhesive is then externally applied to the inductor to mechanically bond the core to the shield. Application of the external adhesive adds a manufacturing step and associated expense to the inductor fabrication process. Additionally, a smooth and polished surface of the spacing tape can undesirably compromise the bonding between the tape and the shield, and because it is difficult to externally apply adhesive to an entire surface area of the core within the shield, only a portion of the core surface area is bonded to the shield. Poor bonding of the core to the shield can undesirably affect performance of the inductors.

BRIEF SUMMARY OF THE INVENTION

In an exemplary embodiment, a method for fabricating an inductor includes the step of wrapping an epoxy tape around a perimeter of an inductor core, positioning the wrapped core into a shield, and reflowing the epoxy tape to form a uniform bond between the core an the shield.

More specifically, the epoxy tape includes a layer of structural adhesive film laminated to an adhesive layer. The structural adhesive film is affixed to the perimeter of the core, and the core is bonded to the shield by heating the adhesive layer of the epoxy tape to a transition temperature to melt the adhesive layer, and curing the adhesive layer to a solid state bonded to the shield.

The epoxy tape ensures centering of the coil and core within the shield and further ensures a complete bonding between the core and the shield, thereby improving inductor performance and reliability while avoiding conventional manufacturing steps.

DETAILED DESCRIPTION OF THE INVENTION

Figure 1:
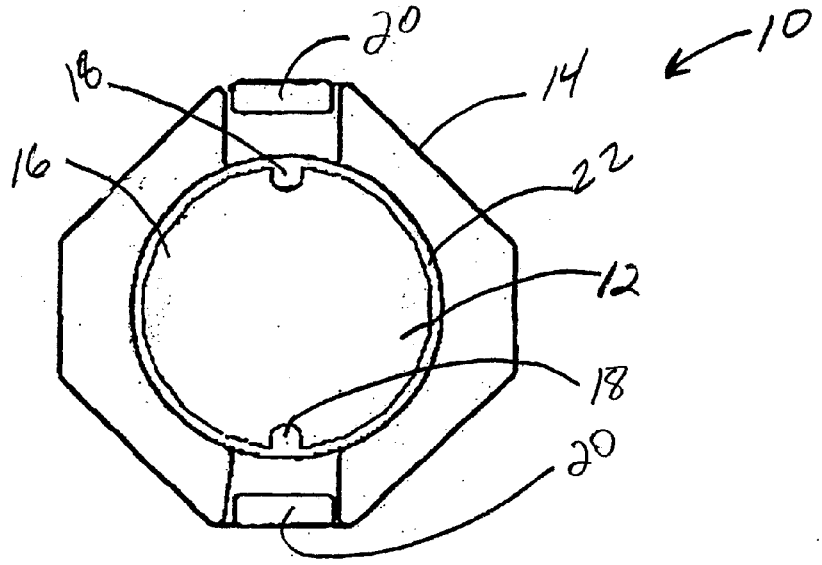
FIG. 1 is a top plan assembly view of an inductor.

FIG. 1 is a top plan view of an illustrative embodiment of an inductor 10 in which the benefits of the invention are demonstrated. It is recognized, however, that inductor 10 is but one type of electrical component in which the benefits of the invention may be appreciated. Thus, the description set forth below is for illustrative purposes only, and it is contemplated that benefits of the invention accrue to other sizes and types of inductors as well as other passive electronic components. Therefore, there is no intention to limit practice of the inventive concepts herein solely to the illustrative embodiment described, that is inductor 10.

Inductor 10 includes a core 12, sometimes referred to as a drum, and a shield 14. A coil of conductive wire (not shown) is wound onto core 12, and the coil and core 12 are disposed within a protective shield 14. The coil includes a number of turns of conductive wire in order to achieve a desired inductance value for a selected end application of inductor 10. As those in the art will recognize, an inductance value of inductor 10, in part, depends upon wire type, a number of turns of wire in the coil, and wire diameter. As such, inductance ratings of inductor 10 may be varied considerably for different applications Shield 14, in one embodiment, is fabricated from a magnetic material to provide both a magnetic path and mechanical protection for the coil of inductor 10 both mechanically and electrically. Shield 14 includes a bore for receiving core 12 therein, and serves to provide a path for concentrating the magnetic field between ends of coil 10, thus containing the magnetic field to strengthen the field around the coil and reduce the effect of the field on the ambient environment. In the embodiment illustrated in FIG. 1, shield 14 includes an eight sided polygonal outer perimeter, but in alternative embodiments it is recognized that greater or fewer perimeter sides, including one or more curved sides, could likewise be used in alternative embodiments without departing from the scope of the present invention.

Core 12 in an illustrative embodiment is fabricated from a low loss powdered iron or other iron based ceramic material, although in other embodiments other known suitable materials may be employed. In a further embodiment, core 12 is spool shaped and includes a generally cylindrically, elongated inner circumference section (not shown) of a first diameter disposed between two generally flat disk-like outer circumference sections 16 (only one of which is shown in FIG. 1) of a larger diameter than the inner circumference section first diameter. Outer circumference sections extend from opposing ends of the inner circumference section, and as shown in the FIG. 1, outer circumference sections 16 each include a plurality of indentations or guides 18 which are configured for guiding and retaining leads (not shown) of a conductive wire coil wound about the inner circumference section of core 12 as the leads extend from the inner circumference section of core 12.

Centering of core 12 and the associated coil within shield 14 maintains a desired open circuit inductance and a selected inductor bias (open circuit inductance with DC current). Coil leads extend through guides 18 for attachment to a circuit (typically a circuit board), or, in an alternative embodiment, the leads are connected to insulated posts 20 located on and extending from opposing sides of the outer perimeter of shield 14 for surface mounting of inductor 10 on a printed circuit board (not shown) according to known techniques When core 12 is properly centered within shield 14, a uniform gap or clearance 22 is maintained about the circumference of the coil and core 12. In one embodiment, clearance 22 is approximately 0.004 inches to about 0.005 inches wide, although in alternative embodiments greater or lesser clearances may be employed.

Figure 2:
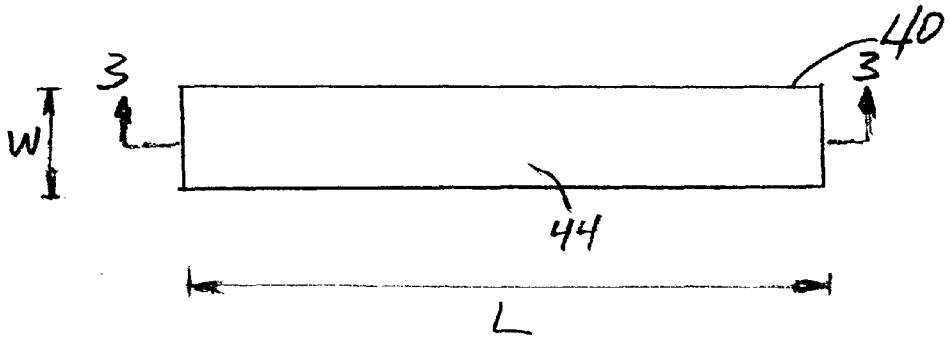
FIG. 2 is a top plan view of an epoxy tape for the inductor shown in FIG. 1.
Figure 3:
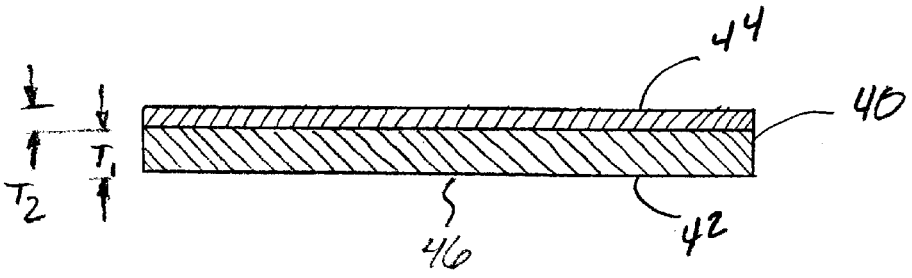
FIG. 3 is cross sectional view of the epoxy tape shown along line 3—3 in FIG. 2.

FIGS. 2 and 3 are a top plan view and cross sectional view, respectively, of one embodiment of an epoxy tape 40 for use in constructing inductor 10 in an exemplary embodiment of the present invention. Epoxy tape 40 includes a first layer for affixing to the core, and a second layer for forming a bond with shield 14. More specifically, tape 40 includes a structural adhesive film 42 and a laminating adhesive 44.

In one exemplary embodiment, structural adhesive film 42 includes an epoxy base resin, such as an "AF42" bonding film available from Minnesota Mining and Manufacturing Company (3M™) of St. Paul, Minn., and laminating adhesive 44 is a solvent-free acrylic adhesive, such as "467MP" roll laminating adhesive, also available from Minnesota Mining and Manufacturing Company (3M™) of St. Paul, Minn. As such, structural adhesive film 42 has adequate heat resistance and structural bond properties for the operating environment of inductor 10, and laminating adhesive 44 exhibits sufficient humidity resistance, U.V. resistance, water resistance, chemical resistance and shear strength to withstand manufacturing, assembly, and operating environments of inductor 10.

In alternative embodiments, other known materials having similar properties and characteristics may be employed to fabricate tape 40 fur use in inductor 10 as described below.

In one exemplary embodiment for fabrication of an inductor, such as inductor 10, tape 40 has a length L of approximately 12 millimeters and a width W of about 1.6 millimeters. Further, structural adhesive film 42 has a thickness $T_1$ of about 3 mils and laminating adhesive 44 has a thickness $T_2$ of about 2 mils. It is recognized that this is but one exemplary embodiment with exemplary dimensions, and that other dimensions both smaller and larger may be used in alternative embodiments within the scope of the present invention.

A bottom surface 46 of structural adhesive film 42 is gummy or tacky and is affixed to the perimeter of core 12 after the conductive wire coil is wound therein, such that epoxy tape 40 substantially occupies clearance 22 (shown in FIG. 1) when core 12 (shown in FIG. 1) is inserted into shield 14. Once located in clearance 22 after structural adhesive film 42 is bonded to the outer circumference of core 14, epoxy tape 40, and more specifically, laminating adhesive 44, is bonded to an inner circumference of shield 14 using a heating and curing process. The heating and curing process is sometimes referred to as a reflow process via heating of laminating adhesive 44 to a transition temperature that causes the adhesive to melt and "flow" within clearance 22, and then curing laminating adhesive back to a solid state. As such, laminating adhesive 44 uniformly forms a mechanical bond between core 12 and shield 14, and more specifically between shield 14 and structural adhesive film 42. It is believed that those in the art could accomplish this type of heating and curing process without further description or explanation.

In one embodiment, both structural adhesive film 42 and laminating adhesive 44 are translucent so that a proper positioning of core 12 within shield 14 may be optically confirmed. In an alternative embodiment, epoxy tape 40 is fabricated from opaque materials. It is contemplated, however, that visual or optic assurance of proper positioning of shield 14 with respect to core 12 could be accomplished with opaque materials as well, including but not limited to selection of appropriate color combinations of tape 40, shield 14 and core 12 to facilitate visual confirmation of spacing between core 12 and shield 14.

Figure 4:
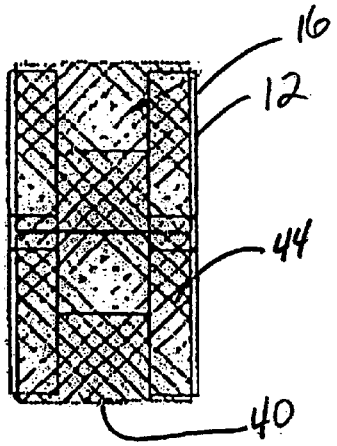
FIG. 4 is a side view of a portion of the inductor shown in FIG. 1 at a first stage of manufacture.

FIG. 4 is a side view of inductor core 12 at a first stage of manufacture wherein the conductive coil (not shown) is wrapped around the inner circumference of core 12 and epoxy tape 40 is wrapped around an outer circumference of core 12. Tape bottom surface 46 (shown in FIG. 3) is affixed to outer circumference sections 16 (also shown in FIG. 1) of the outer perimeter of core 12, or in other words, tape bottom surface 46 is adhered to core 12 such that laminating adhesive 44 is "face up" on the external surface of core 12 when tape 40 is attached to core. As shown in FIG. 4, laminating adhesive 44 of epoxy tape 40 is exposed when tape 40 has been affixed to outer circumference sections 16 of core 12.

Figure 5:
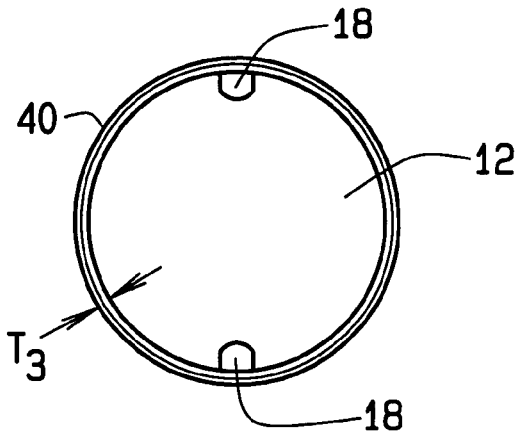
FIG. 5 is a top plan view of the portion of the inductor shown in FIG. 4.

FIG. 5 illustrates core 12 with tape 40 affixed thereto and circumscribing core 12 in a substantially uniform fashion. In an illustrative embodiment, tape 40 retains leads (not shown) of the conductive coil wound into core 12 and extending from the coil through guides 18. In various embodiment, tape 40 is wrapped around the outer perimeter of the core one or more times to form a wrapping thickness $T_3$ sufficient to fill clearance 22 (shown in FIG. 1) when tape 40 is reflowed to bond core 12 to shield 14.

Figure 6:
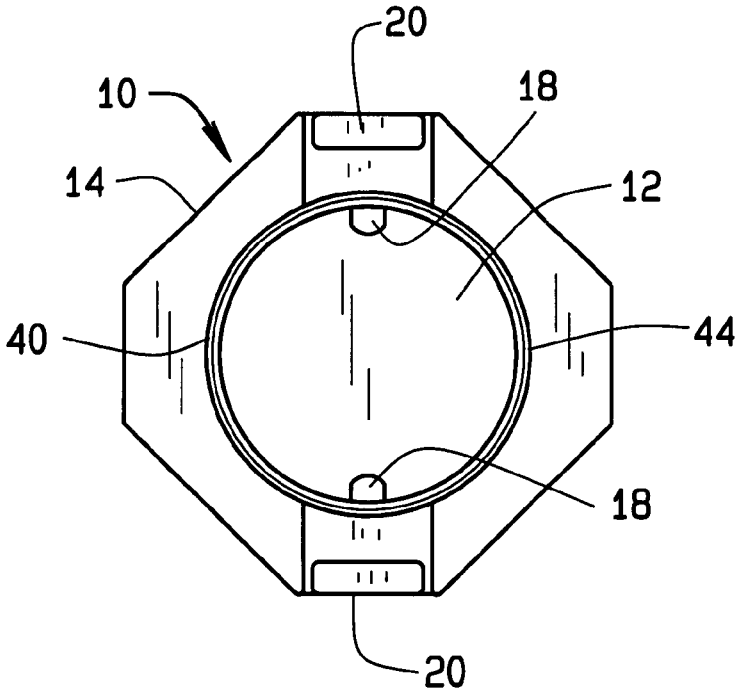
FIG. 6 is a top plan view of the inductor shown in FIG. 1 at a second stage of manufacture.

FIG. 6 illustrates inductor 10 at a second stage of manufacture after tape 40 is reflowed and cured to solid form to form a strong bond between core 12 and shield 14. Unlike conventional manufacturing methods including application of external epoxy glue to bond core 12 to shield 14, reflowed tape 40 provides optimal uniform spacing and bonding between core 12 and shield 14 about substantially an entire outer surface of wrapped core 12. Coil leads (not shown) are extend through guides 18 for attachment to insulated posts 20 extending from shield 14 for electrical connection to a circuit or a circuit board according to known methods and techniques.

Use of reflowing epoxy tape 40 removes conventional liquid adhesive dispensing process and associated costs, as well as eliminates potential quality issues from associated incomplete or inadequate bonds. Further, elimination of the dispensing process allows improvements in the consistency of the bond between core 12 and shield 14, thereby allowing for reductions in physical size of inductor 10 while maintaining comparable power ratings in comparison to conventionally manufactured inductors.

While the invention has been described in terms of various specific embodiments, those skilled in the art will recognize that the invention can be practiced with modification within the spirit and scope of the claims.

What is claimed is:

1. A miniature power inductor for electronic circuitry, said inductor comprising:

a core comprising a lead for coupling to an electronic circuit;

a shield configured to receive said core; and an epoxy tape wrapped around said core to substantially center said core relative to said shield, said tape configured to reflow and bond to said shield.

2. An inductor in accordance with claim 1 wherein said epoxy tape comprises a first layer and a second layer, one of said first and second layers comprising a layer of structural adhesive film.

3. An inductor in accordance with claim 2, the other of said first and second layers comprising a laminating adhesive.

4. An inductor in accordance with claim 3 wherein said laminating adhesive is configured to bond to said shield upon heating and curing of said laminating adhesive.

5. An inductor in accordance with claim 3 wherein said laminating adhesive comprises an epoxy resin.

6. An inductor in accordance with claim 2 wherein said layer of structural adhesive film and said layer of laminating adhesive are translucent.

7. An inductor in accordance with claim 2 wherein said layer of structural adhesive film is configured to adhere to a circumference of said core.

8. An inductor in accordance with claim 2 wherein said structural adhesive film comprises an acrylic adhesive.

9. A miniature power inductor for a printed circuit board, said inductor comprising:

a shield comprising a bore therethrough; and a core disposed within said bore, said core comprising an outer circumference and a tape affixed to said outer circumference, said tape comprising a structural adhesive film affixed to said outer circumference and a reflowed laminating adhesive forming a substantially uniform bond to said shield and substantially centering said core with respect to said shield.

10. An inductor in accordance with claim 9 wherein said structural adhesive film comprises an acrylic adhesive.

11. An inductor in accordance with claim 9 wherein said laminating adhesive comprises an epoxy resin.

12. An inductor in accordance with claim 9 wherein said epoxy tape is translucent.

13. An inductor in accordance with claim 9 wherein said structural adhesive film has a thickness of about 3 mils.

14. An inductor in accordance with claim 9, said tape occupying a clearance between said core and said shield, said clearance having a dimension of about 0.004 inches to about 0.005 inches.

15. An inductor in accordance with claim 9 wherein said shield is adapted for surface mounting to a printed circuit board.

* * * * *